United States Patent [19]

Salvati et al.

[11] 4,074,218

[45] Feb. 14, 1978

[54] CIRCUIT BREAKER

[75] Inventors: John G. Salvati, Patterson Township, Beaver County; Paul Skalka, Beaver, both of Pa.

[73] Assignee: Westinghouse Electric Corporation, Pittsburgh, Pa.

[21] Appl. No.: 684,140

[22] Filed: May 7, 1976

[51] Int. Cl.[2] ..... H01H 9/00

[52] U.S. Cl. ..... 335/176; 335/42; 335/274

[58] Field of Search ..... 335/176, 273, 274, 42, 335/45, 173

[56] References Cited

U.S. PATENT DOCUMENTS

| | | | |
|---|---|---|---|
| 3,391,361 | 7/1968 | Jencks et al. | 335/176 |
| 3,797,007 | 3/1974 | Salvati et al. | 335/176 |
| 3,845,432 | 10/1974 | Heberlein | 335/176 |
| 3,906,414 | 9/1975 | Kidd et al. | 335/176 |

*Primary Examiner*—Harold Broome
*Attorney, Agent, or Firm*—L. P. Johns

[57] ABSTRACT

A circuit breaker responsive to abnormal currents in conductors of an electrical distribution system characterized by separable contacts and trip means therefor, which means comprises a stationary magnetic structure for each conductor including a magnetic coil and core assembly and armature therefor, a lever associated with each stationary magnetic structure removing a trip bar to an unlatched position, the lever comprising the armature and being movable in response to abnormal currents in at least one of the conductors, and tension means for varying tension on the lever and including a manually operable cam, cam follower, and tension spring operatively connected between the cam follower and the lever for adjusting the force required to attract the armature to said assembly.

4 Claims, 6 Drawing Figures

CIRCUIT BREAKER

CROSS-REFERENCE TO RELATED APPLICATIONS

This invention is related to that disclosed in the applications of Albert E. Maier and William I. Stephenson, Jr., Ser. No. 345,394, filed Mar. 27, 1973; and of John G. Salvati and Paul Skalka, Ser. No. 346,230, filed Mar. 19, 1973, now Pat. No. 3,797,007.

BACKGROUND OF THE INVENTION

1. Field of the Invention

This invention pertains to a protective device for a circuit interrupter and, more particularly, it pertains to means for varying the magnetic trip range while maintaining a constant air gap in the magnetic circuit.

2. Description of the Prior Art

Generally, circuit breakers with overcurrent protective devices have external mounting means on the circuit breaker housing such as disclosed in U.S. Pat. No. 3,530,414. Circuit breakers of that type have functioned satisfactorily for responding to such abnormal currents as overcurrents, ground fault currents, and short circuits that occur in an electrical distribution system. However, certain disadvantages result from that type of construction including the inability to vary the magnetic trip ranges such as from five to ten times the nominal rating of a trip unit.

SUMMARY OF THE INVENTION

In accordance with this invention, it has been found that the foregoing disadvantages may be overcome by providing a protective device for a circuit interrupter comprising a cicuit breaker mechanism having separable contacts adapted to be connected as part of the distribution system, the circuit breaker mechanism also comprising a releasable member movable from a latched position to effect opening of the contacts, a latch lever movable between latched and unlatched positions of the releasable member and being biased in the latched position, a stationary magnetic structure for each conductor of the distribution system and comprising a coil and core assembly and an armature, a trip bar movable to unlatch the latch lever and being biased in the latched position, a lever associated with each stationary magnetic structure for moving the trip bar to the unlatched position, the lever comprising the armature and being movable in response to abnormal currents in at least one of the conductors, tension means for varying tension on the lever and comprising a bracket, a cam, a cam follower, and spring means, the bracket being pivotally mounted and operatively connected to the lever, the spring means comprising at least one spring between the bracket and the cam follower, and the cam comprising a normally rotatable knot.

The advantage of the device of this invention is that it provides a novel means for loading the armature of a circuit breaker magnetic trip circuit to obtain from five to ten times the normal rating of the trip unit.

DESCRIPTION OF THE PREFERRED EMBODIMENT

Figure 1:
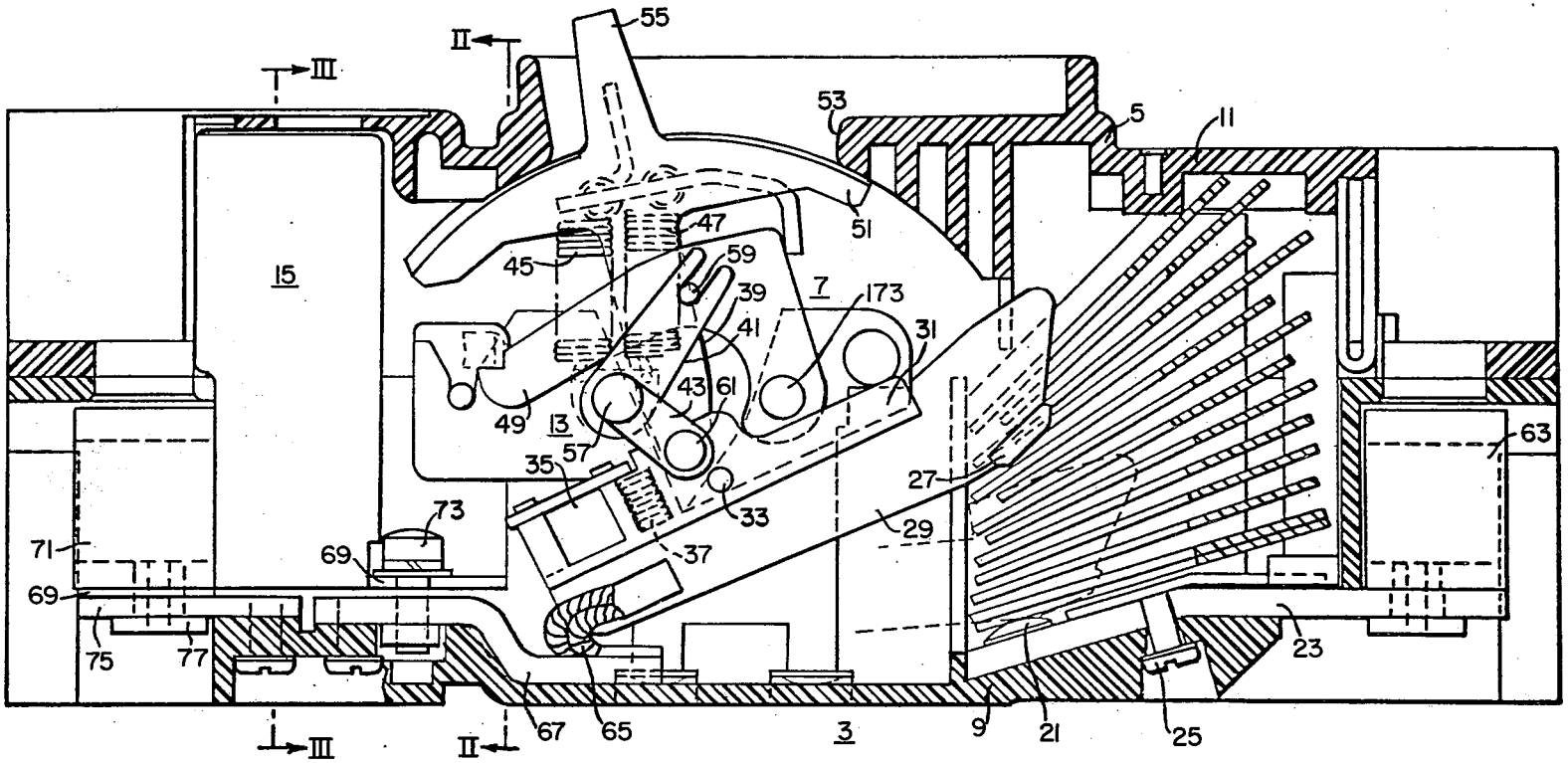
FIG. 1 is a vertical sectional view of a multi-pole circuit breaker.
Figure 2:
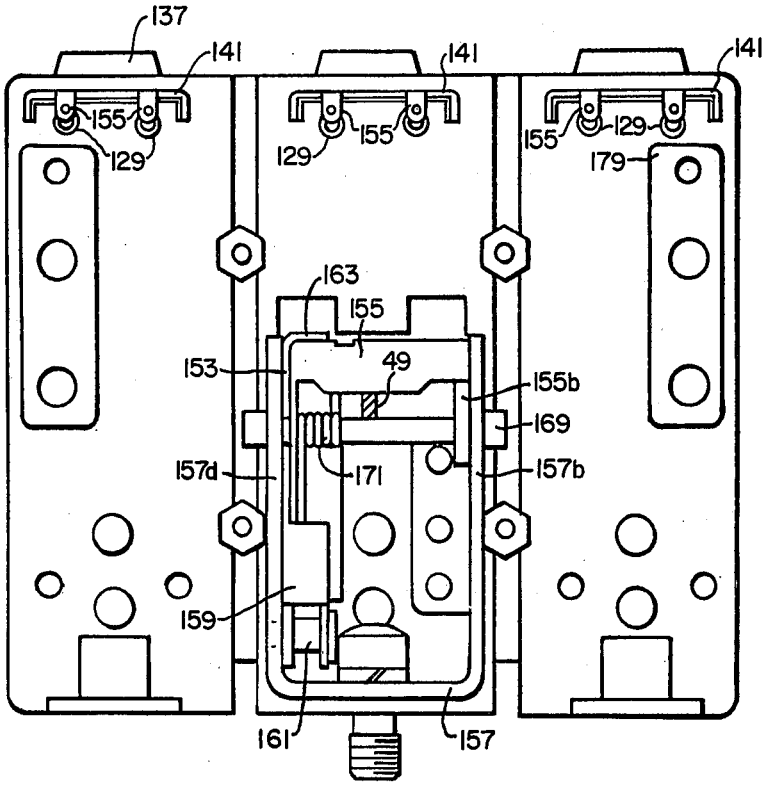
FIG. 2 is a vertical sectional view taken on the line II—II of FIG. 1.

In FIG. 1, a circuit breaker is generally indicated at 3 and it comprises an insulating housing 5 and a circuit breaker mechanism 7 supported within the housing. The housing 5 comprises an insulating base 9 and an insulating cover 11.

The circuit breaker mechanism 7 comprises an operating mechanism 13, and a latch and trip device 15. Except for the latch and trip device, the circuit breaker 3 is of the type that is generally described in the patent to Albert R. Cellerini et al, U.S. Pat. No. 3,287,534, issued Nov. 22, 1966, and is incorporated by reference herein. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolts 25. In each pole unit, a movable contact 27 is secured, such as by welding or brazing, to a contact arm 29 that is mounted on a switch arm 31 by a pivot pin 33. The arms 29 and 31 for all three of the pole units are supported at one end thereof and rigidly connected on a common insulating tie bar 35 by which the arms of all three pole units move in unison. Each of the contact arms 29 is biased about the associated pivot pin 33 by means of a spring 37 to provide contact pressure in the closed position.

The operating mechanism 13 actuates the switch arms 31 between open and closed positions. The mechanism comprises a pivoted formed operating lever 39, a toggle comprising two toggle links 41 and 43, overcenter springs 45 and 47, and a pivoted releasble cradle or arm 49 controlled by the trip device 15. An insulating shield 51 for substantially closing an opening 53 in the cover 11, is mounted on the outer end of the operating lever 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 31 of the center pole unit by a pin 61. The overcenter springs 45 and 47 are connected under tension between the knee pivot pin 57 and the outer end of the operating lever 39. The circuit breaker is manually operated to the open position by movement of the handle portion 55 in a counterclockwise direction to the "off" position, which movement actuates the overcenter springs 45, 47 to collapse the toggle links 41 and 43 to the position shown in FIG. 1, and opening movement of the contact arm 29 for all of the pole units in a manner well known in the art.

The circuit breaker is manually closed by reverse movement of the handle portion 55 from the "off" position to the "on" position, which movement causes the springs 45, 47 to move overcenter and straighten the toggle links 41, 43, thereby moving the contact arm 29 for all of the pole units to the closed position as shown in broken line position.

The trip device 15 serves to effect automatic release of the releasable cradle or arm 49 and opening of the breaker contacts for all of the pole units, in response to predetermined overload conditions in the circuit breaker through any or al pole units of the circuit breaker, in a manner described hereinbelow.

The circuit through each pole unit extends from a right-hand terminal 63 through the conductor 23, the contacts 21, 27, the contact arm 29, a flexible conductor 65, that is secured to the contact arm 29, a conductor 67, a trip conductor 69, and to a left-hand terminal connector 71. Bolt means 73 secure one end of the trip conductor 69 to the conductor 67 and the other end of the trip conductor 69 is disposed between a backup plate 75 and the terminal 71 where it is secured in place by mounting bolt 77 of the terminal 71.

Figure 3:
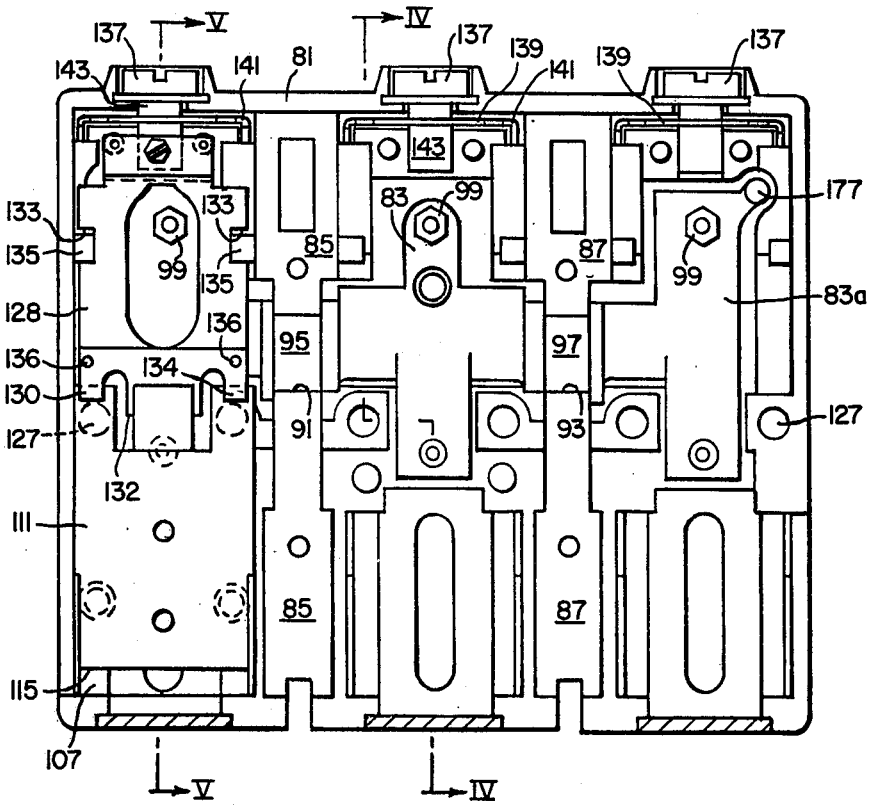
FIG. 3 is a vertical sectional view taken on the line III—III of FIG. 1.
Figure 4:
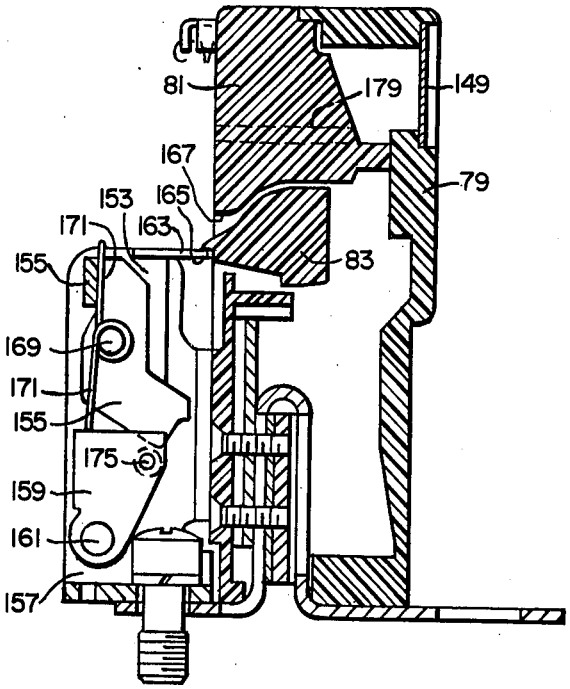
FIG. 4 is a vertical sectional view taken on the line IV—IV of FIG. 3.
Figure 5:
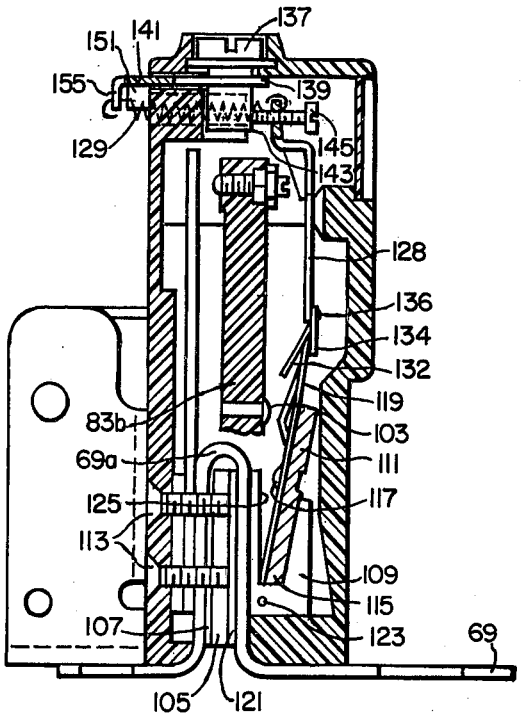
FIG. 5 is a vertical sectional view taken on the line V—V of FIG. 3; and, FIG. 6 is a plan view, partly in section, of the trip device shown in FIGS. 2–5.
Figure 6:
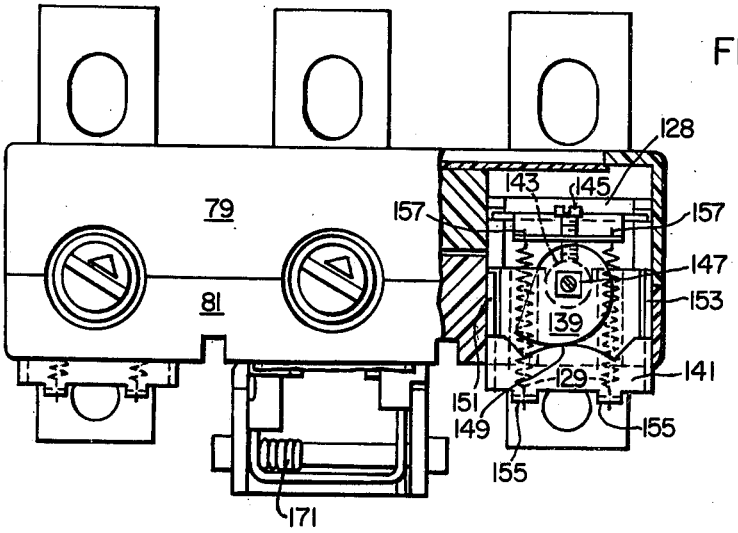

As shown in FIGS. 2–6 the latch and trip device 15 comprises a molded insulating housing base 81 and a molded insulating housing cover 79 secured to the base to enclose a molded insulating trip bar 83 that is common to all three of the pole units. In FIG. 3, the base 81 includes a pair of spaced partitions 85 and 87 which are vertically disposed and integral with the base for separating the interior of the housing into three compartments, each compartment containing one of the three poles. In a similar manner, the cover 79 is provided with partitions corresponding to partitions 85 and 87 and have mating surfaces therewith in a manner similar to the mating surfaces of the peripheral surfaces of the base 81 and cover 79 as indicated by a parting line 89 (FIG. 6).

As shown in FIG. 3, the partitions 85 and 87 have notches 91 and 93, respectively, which together with flat surfaces of the cover 79 serve as journals for round shaft portions 95 and 97 of the trip bar 83. Accordingly, when the housing base 81 and cover 79 are assembled, they retain the trip bar in place, whereby the trip bar is free to rotate on an axis extending through the shaft portions 95 and 97. As shown more particularly, in FIG. 5, each section of the trip bar 83 located within the space compartments of the housing comprise upper and lower portions **83*a* and 83*b*, which are above and below the axis of rotation of the trip bar. Each upper portion 83*a* is provided with an adjusting screw and nut assembly 99 which cooperates with a bimetal member 101 (FIG. 5) for adjusting the spacing between the upper ends of the bimetal member and the trip bar portion 83*a* in response to the of deflection of the upper end of the member 101 toward the member 83*a*, whereby the trip bar 83 is rotated clockwise by the bimetal member and thereby trips the circuit breaker to the open position. The lower end portion 83*b* of the trip bar 83 is preferably provided with a drive screw 103** by which contact is made with an adjoining member for similar rotation of the trip bar in the manner to be described hereinbelow.

The trip conductor 69 (FIG. 5) includes an inverted U-shaped intermediate portion **69*a* which constitutes a single loop of a stationary magnetic structure. Stationary magnetic structure also comprises a magnetic core 105, a U-shaped frame 107 having a pair of spaced flanges 109 one of which is shown in FIG. 5, and an armature 111. The assembly of the intermediate U-shaped portion 69*a*, the core 105, and the intermediate portion of the frame 107 together with the lower portion of the bimetal member 101 are secured in place by suitable means such as rivets 113 on the housing base 79. The lower end portion of the bimetal member 101 is in surface-to-surface contact with the conductor 69, whereby upon the occurrence of a low persistent overload current below a predetermined value of, for example, ten times normal rate current, the bimetal member 101 is heated and deflects to the right through an air gap dependent upon the setting of the adjustment screw 99. Thus, when a low persistent overload current occurs, the trip bar 83** is actuated to trip the circuit breaker.

The armature 111 is disposed between the space flanges 109 of the U-shaped frame 107 and is pivotally mounted therein to rotate about an axis 115 near the lower end of the armature. For that purpose, the armature 111 is preferably mounted by suitable means such as rivets 117 on a support lever 119 having oppositely extending out-turned lugs 121 which are seated in corresponding openings 123 in the flanges 109. Each flange 109 is also provided with a V-shaped notch or air gap 125 into which edge portions of the lever 119 and armature 111 extend. The notches 125 thereby limit movement of the assembly of the lever 119 and armature 111 when the armature is attracted toward the core 105. Accordingly, the assembly of the lever 119 and armature 111 which is biased in the clockwise direction by coil springs 127 (FIG. 3) is movable counterclockwise against the springs to engage the drive screw 103 and thereby rotates the trip bar 83 clockwise. When an overload current above a value such, for example, as ten times normal rated current or a short circuit current occurs, the stationary magnetic structure is energized and the armature 111 is attracted toward the core 105 causing instantaneous release of the releasable arm 49 and opening of the contacts 21 and 27.

In addition to the foregoing, means are provided for adjusting the spacing between the armature 111 and the core 105, whereby upon maximum spacing of the armature from the core, a greater current overload is required to attract the armature toward the core. Conversely, when the spacing is reduced, a smaller overload current is required to actuate the trip bar 83. For that purpose an adjustment bracket 128, having a lower end disposed over the upper end of the lever 119, is mounted within the housing and is provided with calibration means including a calibration screw 131 at the upper end of the bracket 128. As shown in FIG. 3, each bracket 128 includes a notch 133 on each opposite side thereof which notch is seated in corresponding projections 135 of the housing base 79.

The foregoing is prior art as disclosed in the application of John G. Salvati and Paul Skalka, Ser. No. 346,230, filed Mar. 29, 1975.

In accordance with this invention the bracket 128 comprises means for varying the trip range from at least five to ten times the nominal rating of the trip unit in the magnetic circuit. For that purpose the bracket 128 comprises tension means for varying tension on the lever 119 maintaining the armature at a constant air gap 125. The tension means comprise tension springs 129 (FIGS. 5 and 6) and spaced prongs or fingers 130, 132, 134 (FIG. 3). The outer fingers 130 and 134 extend over one side of the armature 111 and the middle finger 132 extends on the other side of the armature, so that the middle finger 132 is located on the core side of the armature. The fingers 130, 132, 134 may be an integral part of the bracket 128, or preferably part of a separate member that is fixedly attached to the bracket by suitable means such as rivets 136.

In addition, the tension means comprises an adjusting knob 137 which is seated within the top of the housing and is provided with lower portion 143. The bracket 128 is biased counterclockwise around its pivot point by springs 129. The calibration screw 131 is mounted in the upper end portion of the bracket to ride on the lower portion 143 in order establish the desired constant air gap 125. For example, if necessary to trip the circuit breaker at 500 amperes and a prior setting of the air gap is actually tripping at 600 amperes, the air gap can be made smaller by the calibration screw 145 to lower the tripping current to 500 amperes. Once the air gap 125 is established for the desiring rating, it remains constant. Thereafter, the adjusting knob 137 is turned to rotate a cam 139 to increase or decrease the spring tension on the armature 111 through the bracket moment arm 128. As shown more particularly in FIG. 6 the cam 139 is mounted on a square portion 147 of the adjusting knob 137 and is in contact at 149 with the cam follwer 141. The cam follower 141 is seated in the opening in the housing and includes a pair of spaced parallel guide portions 151, 153 to facilitate movement of the cam follower 141. In addition the cam follower includes a pair of down-turned tabs 155 to which the outer end of the springs 129 are attached. The other ends of the springs are attached to the upper end of the bracket 128 at 157. Accordingly, when the cam is rotated to the position shown in FIG. 6, the cam follower 141 is extended outwardly as shown in FIGS. 5 and 6 to stretch the springs 129 and thereby apply greater tension on the upper end of the bracket 128. In this manner, the magnetic trip range may be varied from five to 10 times the nominal rating of the trip unit. The force required to move the armature by the magnetic flux may be increased or decreased by increasing or decreasing the tension in the coil springs 129 on five to ten times the current overloads. The magnetic flux developed in the working air gap 125 becomes sufficient to create forces that pull the armature toward the magnet. Before the armature comes to rest against the magnet, it strikes the trip bar 83 and thus affects tripping of the circuit breaker.

Accordingly, the device of the present invention provides a new and novel trip device for a circuit breaker which comprises means for increasing the electrical current range between maximum and minimum limits of the magnetic circuit by increasing or decreasing spring tension on the armature.

What is claimed is:

1. A circuit breaker responsive to abnormal currents in the conductors of an electrical distribution system and for actuating a circuit interrupter to open upon the occurrence of predetermined operating conditions, comprising a circuit breaker mechanism having separable contacts adapted to be connected as part of the distribution system, the circuit breaker mechanism also comprising a releasable member movable from a latched position to effect opening of the contacts, a latch lever movable between latched and unlatched positions of the releasable member and being biased in the latched position, a stationary magnetic structure for each conductor of the distribution system and comprising a coil and core assembly and an armature, a trip bar movable to unlatch the latch lever and being biased in the latched position, lever means associated with each stationary magnetic structure for moving the trip bar to the unlatched position, the lever means comprising the armature and being movable in response to abnormal currents in at least one of the conductors, the armature being positioned at a constant distance from said assembly, tension means for varying tension on the lever means and comprising adjustable spring means operatively connected to the lever means so that the force required to attract the armature to said assembly is adjustable without varying the distance between the armature and said assembly, the tension means also comprising a manually rotatable cam and a cam follower, and the cam follower being operatively connected to the spring means for increasing and decreasing tension on the spring means in response to rotation of the cam.

2. The circuit breaker of claim 1 in which rotating means are provided on the cam for rotating the cam.

3. The circuit breaker of claim 2 in which the springs means comprises at least one spring extending between the bracket and the cam follower.

4. The circuit breaker of claim 3 in which an adjusting screw is disposed between the bracket and the rotating means for calibrating the distance between the armature and said assembly.

* * * * *